US008547367B2

(12) United States Patent
Kim et al.

(10) Patent No.: US 8,547,367 B2
(45) Date of Patent: Oct. 1, 2013

(54) METHOD FOR RESTORING A TIMING CONTROLLER AND DRIVING DEVICE FOR PERFORMING THE METHOD

(75) Inventors: Yong-Bum Kim, Yongin-si (KR); Jae-Gwan Jeon, Incheon (KR); Dong-Won Park, Asan-si (KR); Bong-Ju Jun, Cheonan-si (KR); Dong-Hyun Yeo, Goyang-si (KR)

(73) Assignee: Samsung Display Co., Ltd. (KR)

( * ) Notice: Subject to any disclaimer, the term of this patent is extended or adjusted under 35 U.S.C. 154(b) by 269 days.

(21) Appl. No.: 13/178,939

(22) Filed: Jul. 8, 2011

(65) Prior Publication Data

US 2012/0139882 A1 Jun. 7, 2012

(51) Int. Cl.
*G09G 5/00* (2006.01)

(52) U.S. Cl.
USPC ..... 345/204; 345/98

(58) Field of Classification Search
USPC ..... 345/98, 99, 204
See application file for complete search history.

(56) References Cited

U.S. PATENT DOCUMENTS

| | | | | |
|---|---|---|---|---|
| 7,864,153 | B2 * | 1/2011 | Yun et al. | 345/99 |
| 2006/0197730 | A1 * | 9/2006 | Ooga et al. | 345/98 |
| 2007/0164969 | A1 * | 7/2007 | Kim | 345/99 |
| 2008/0117158 | A1 * | 5/2008 | Kim et al. | 345/99 |
| 2008/0129761 | A1 * | 6/2008 | Kim et al. | 345/690 |
| 2008/0284703 | A1 * | 11/2008 | Chao et al. | 345/92 |
| 2010/0033453 | A1 * | 2/2010 | Park et al. | 345/204 |
| 2010/0302214 | A1 * | 12/2010 | Kim et al. | 345/204 |

FOREIGN PATENT DOCUMENTS

| | | | | |
|---|---|---|---|---|
| JP | 05-265395 | A | | 10/1993 |
| JP | 05265395 | A | * | 10/1993 |
| KR | 2005090644 | A | * | 9/2005 |
| KR | 1020050090644 | A | | 9/2005 |
| KR | 2005104929 | A | * | 11/2005 |
| KR | 1020050104929 | A | | 11/2005 |
| KR | 2008082075 | A | * | 9/2008 |
| KR | 1020080082075 | A | | 9/2008 |

* cited by examiner

*Primary Examiner* — Joe H Cheng
(74) *Attorney, Agent, or Firm* — Cantor Colburn LLP

(57) ABSTRACT

A method of restoring a timing controller includes generating an error condition signal from a timing controller by checking abnormality of an image signal and a control signal provided from an image board, feeding back the error condition signal to the image board, and restoring the timing controller based on the error condition signal.

20 Claims, 6 Drawing Sheets

FIG. 5

| ADD | COEF | SUM |
|---|---|---|
| 0 | 0 | 0 |
| 1 | 1 | 1 |
| 2 | 2 | 3 |
| 3 | 3 | 6 |
| 4 | 4 | 10 |
| ⋮ | ⋮ | ⋮ |
| 255 | 0 | 252-CS |
| 256 | CS | F=252 |

FIG. 6

| ADD | COEF | SUM |
|---|---|---|
| 0 | 0 | 0 |
| 1 | 1 | 1 |
| 2 | 2 | 3 |
| 3 | 3 | 6 |
| 4 | 4 | 10 |
| ⋮ | ⋮ | ⋮ |
| 255 | 0 | N |
| 256 | CS | N+CS |

METHOD FOR RESTORING A TIMING CONTROLLER AND DRIVING DEVICE FOR PERFORMING THE METHOD

This application claims priority to Korean Patent Application No. 2010-0123643, filed on Dec. 6, 2010, and all the benefits accruing therefrom under 35 U.S.C. §119, the content of which in its entirety is herein incorporated by reference.

BACKGROUND OF THE INVENTION (1) Field of the Invention

Exemplary embodiments of the present invention relate to a method of restoring a timing controller and a driving apparatus for performing the method. More particularly, exemplary embodiments of the present invention relate to a method of restoring a timing controller to enhance display quality of a display panel by removing an error condition of the timing controller in advance, and a driving apparatus for performing the method.

(2) Description of the Related Art

Generally, a display device includes devices such as a liquid crystal display ("LCD") device, a plasma panel display ("PDP") device, an organic light-emitting diode ("OLED") device, a field emission display ("FED") device, for example.

The display device typically includes a timing controller that controls a timing of a control signal or an image signal to provide a display panel with a controlled control signal or a controlled image signal. That is, the timing controller is a core integrated circuit which generates on/off timing signals of active switches on a display panel and performs a converting process of an image data for enhancing a response speed of liquid crystals and display quality.

In general, the timing controller requires various parameters and a look-up table ("LUT") to control the timing controller and drive the display panel in an optimum condition.

The parameters or the LUT are stored in a storage element such as an electrically erasable programmable read only memory ("EEPROM"), for example, and are loaded in the timing controller using an inter-integrated circuit ("$I^2C$") communication when power is applied from an image board. When all parameters are loaded in the timing controller, the timing controller is in a state for driving an LCD device.

A conventional timing controller is started at a time in which all parameters are loaded in the timing controller from the EEPROM. However, even though all parameters are loaded in the timing controller from the EEPROM, a display error on a display panel of the LCD device may occur.

When an input of the timing controller is abnormal or a margin of an inner element for an input of the timing controller is lacking, display defects may occur. When a logic error is caused at a mounting condition that is not anticipated, display defects may occur.

Thus, a condition, in which display defects of the timing controller occur, may be detected in advance at a state that the display panel is not driven. Moreover, a plan capable of removing the condition so as to prevent the display defects is required.

SUMMARY OF THE INVENTION

Exemplary embodiments of the present invention provide a method of restoring a timing controller for removing an error condition of the timing controller in advance.

Exemplary embodiments of the present invention also provide a driving apparatus for performing the above-mentioned method.

In an exemplary embodiment, a method of restoring a timing controller includes generating an error condition signal from a timing controller by checking abnormality of an image signal and a control signal provided from an image board, feeding back the error condition signal to the image board, and restoring the timing controller based on the error condition signal.

In an exemplary embodiment, the generating the error condition signal may include calculating coefficients from the image signal based on a look-up table loaded from an external storage part, comparing the coefficients and the control signal with reference data stored in the external storage part, and generating the error condition signal when the coefficients and the control signal are different from the reference data.

In an exemplary embodiment, the generating the error condition signal may further include counting pulses of the error condition signal, and outputting the error condition signal when a counted number of the pulses of the error condition signal corresponds to a predetermined value.

In an exemplary embodiment, the generating the error condition signal may further include counting pulses of the error condition signal, and outputting the error condition signal when a counted number of the pulses of the error condition signal corresponds to a predetermined value.

In an exemplary embodiment, the comparing the control signal with the reference data may include comparing a clock signal and a data enable signal with the reference data stored in the external storage part.

In an exemplary embodiment, the generating the error condition signal may include detecting a plurality of error conditions different from each other and outputting a plurality of error condition signals based on the plurality of error conditions, and storing the plurality of error condition signals.

In an exemplary embodiment, the stored error condition signals are transmitted to the image board through an inter-integrated circuit ($I^2C$) communication, when the image board requests the plurality of error condition signals.

In an exemplary embodiment, the restoring the timing controller may include altering the calculated coefficients.

In an exemplary embodiment, the generating the error condition signal may include detecting a plurality of error conditions different from each other and outputting a plurality of error condition signals, and performing a logical disjunction on the plurality of error condition signals to output the error condition signal.

In an exemplary embodiment, the restoring the timing controller may include initiating the timing controller.

In an exemplary embodiment, a driving apparatus includes a timing controller which generates an error condition signal by checking abnormality of an image signal and a control signal, and an image board which provides the image signal and the control signal to the timing controller and restores the timing controller based on the error condition signal provided from the timing controller.

In an exemplary embodiment, the timing controller may include a logic part which provides the image signal and the control signal to the timing controller and restores the timing controller based on the error condition signal provided from the timing controller, and an error-detecting part which compares the coefficients and the control signal to generate the error condition signal when the coefficients and the control signal are different from reference data.

In an exemplary embodiment, the timing controller may further include a counter which counts pulses of the error condition signal to output the error condition signal when a counted number of the pulses of the error condition signal corresponds to a predetermined number.

In an exemplary embodiment, the error-detecting part may include a plurality of detecting parts which detects a plurality of error conditions different from each other to output error condition signals, and a register which stores the plurality of error condition signals.

In an exemplary embodiment, the error-detecting part may transmit the stored error condition signals to the image board through an inter-integrated circuit ("$I^2C$") communication, when the image board requests the error condition signals.

In an exemplary embodiment, the image board may alter the coefficients to restore the timing controller.

In an exemplary embodiment, the error condition signal may include at least one of information on existence or non-existence of an error condition, an error condition type, a command required for the image board corresponding to the error condition kinds, and a register value needed for operating the image board.

In an exemplary embodiment, the error-detecting part may include a plurality of detecting parts which detects a plurality of error conditions to output a plurality of error condition signals, and an arithmetic part which performs a logical disjunction on the plurality of error condition signals to output the error condition signal.

In an exemplary embodiment, one of the error condition signals may be outputted to the image board through an output terminal of the timing controller.

In an exemplary embodiment, the image board may initiate the timing controller to restore the timing controller when the error condition signal is inputted thereto.

In exemplary embodiments of the present invention, the timing controller detects an error condition to feed back an error condition signal to an image board, and the image board restores the timing controller based on the error condition signal. Thus, display defects due to an abnormal operation of the timing controller are effectively prevented, and a display quality of a display device is thereby substantially enhanced.

BRIEF DESCRIPTION OF THE DRAWINGS

The above and other features and aspects of the invention will become more apparent by describing in further detail exemplary embodiments thereof with reference to the accompanying drawings, in which:

FIG. 5 is a table showing an example of a checksum stored on an external storage part shown in FIG. 4;

FIG. 6 is a table showing an example of coefficients calculated by a logic part shown in FIG. 4;

DETAILED DESCRIPTION OF THE INVENTION

Figure 1:
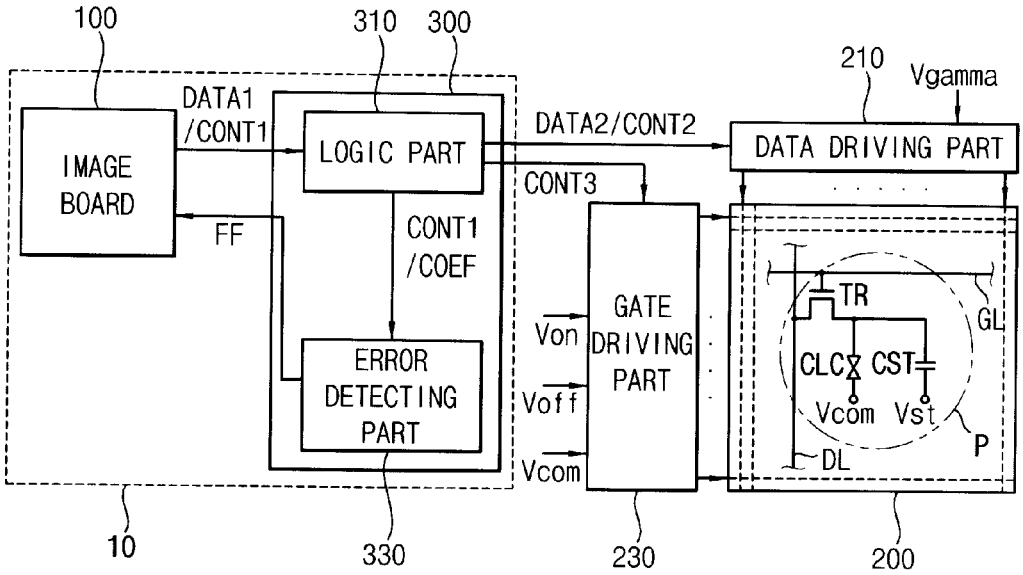
FIG. 1 is a block diagram illustrating an exemplary embodiment of a driving apparatus according to the present invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that when an element or layer is referred to as being "on" or "connected to" another element or layer, the element or layer can be directly on or connected to another element or layer or intervening elements or layers. In contrast, when an element is referred to as being "directly on" or "directly connected to" another element or layer, there are no intervening elements or layers present. Like numbers refer to like elements throughout. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "lower," "under," "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" or "under" relative to other elements or features would then be oriented "above" relative to the other elements or features. Thus, the exemplary term "lower" and "under" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, exemplary embodiments of the present invention will be explained in detail with reference to the accompanying drawings.

Figure 2:
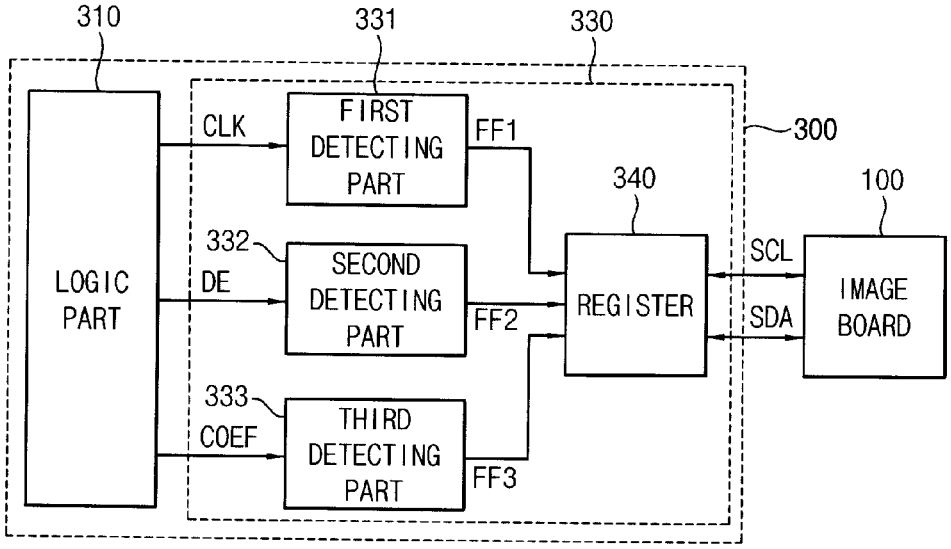
FIG. 2 is a block diagram illustrating an alternative exemplary embodiment of the driving apparatus shown in FIG. 1.
Figure 3:
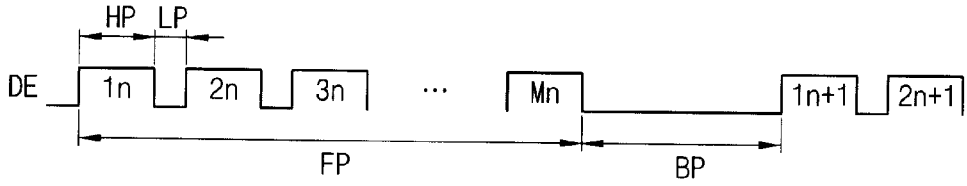
FIG. 3 is a waveform diagram illustrating a data enable signal for explaining an exemplary embodiment of an error condition signal shown in FIG. 2.
Figure 4:
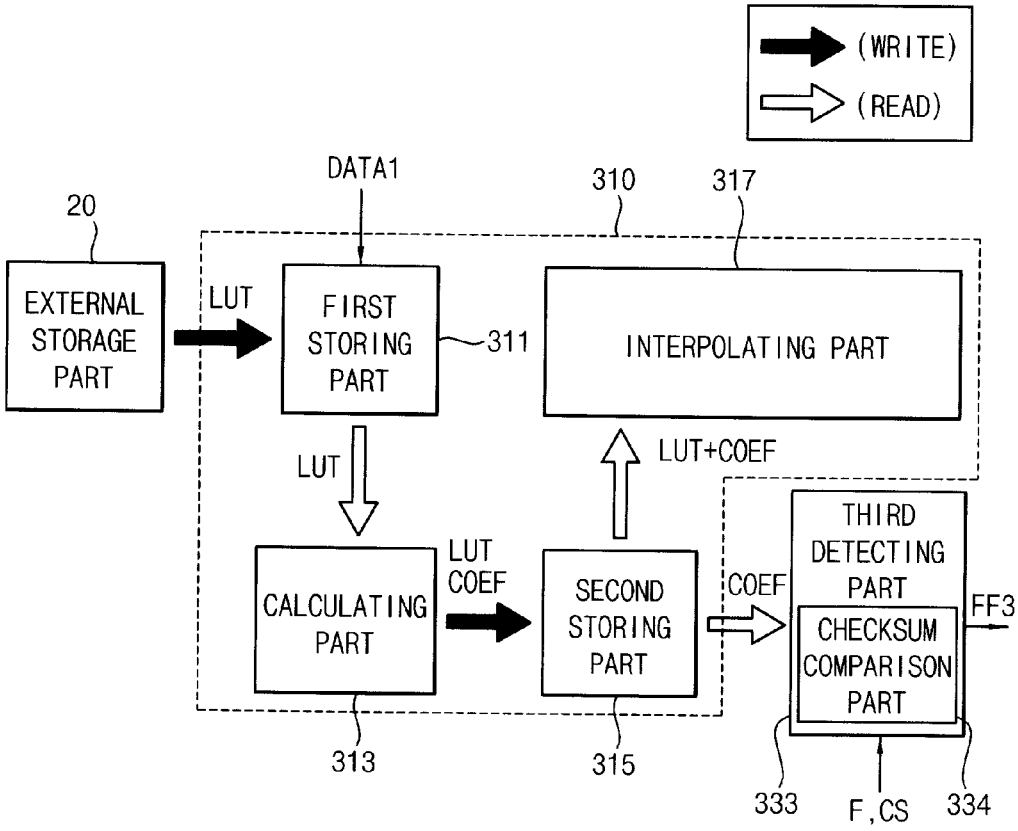
FIG. 4 is a block diagram illustrating an exemplary embodiment of a timing controller shown in FIG. 2 for explaining a coefficient error signal.

FIG. 1 is a block diagram illustrating an exemplary embodiment of a driving apparatus according to the present invention. FIG. 2 is a block diagram illustrating an alternative exemplary embodiment of the driving apparatus shown in FIG. 1. FIG. 3 is a waveform diagram illustrating a data enable signal for explaining an error condition signal shown in FIG. 2. FIG. 4 is a block diagram illustrating an exemplary embodiment of a timing controller shown in FIG. 2 for explaining a coefficient error signal. FIG. 5 is a table showing an example of a checksum stored on an external storage part shown in FIG. 4. FIG. 6 is a table showing an example of coefficients calculated by a logic part shown in FIG. 4.

Referring to FIGS. 1 and 2, the driving apparatus 10 includes an image board 100 and a timing controller 300. For convenience of description, a display panel 200, a data driving part 210 and a gate driving part 230 that are driven by the driving apparatus 10 are described in FIG. 1.

The image board 100 provides the timing controller 300 with a first image signal DATA1 and a first control signal CONT1. The image board 100 receives an image signal from an external device (not shown), and then scales the image signal to the first image signal DATA1 corresponding to a resolution of the display panel 200.

The first image signal DATA1 may be transmitted to the timing controller 300 in a low voltage differential signaling ("LVDS") method. The first control signal CONT1 may include a vertical synchronizing signal, a horizontal synchronizing signal, a main clock signal, a data enable signal DE, for example. The vertical synchronizing signal corresponds to a time during which a single frame is displayed. The horizontal synchronizing signal corresponds to a time during which a single frame line. Thus, the horizontal synchronizing signal includes pulses corresponding to the number of pixels included in the single frame line. The data enable signal corresponds to a time during which data is supplied to a pixel.

The timing controller 300 generates a second image signal DATA2 using the first image signal DATA1, and generates a plurality of timing signals for driving the display panel 200 using the first control signal CONT1. The timing signals include a data control signal CONT2 and a gate control signal CONT3.

In one exemplary embodiment, the data control signal CONT2 may include a horizontal synchronizing signal, a load signal, an inversion signal, a data clock signal, for example, for controlling a driving of the data driving part 210. The gate control signal CONT3 may include a vertical synchronizing signal, a gate clock signal, a gate enable signal, for example, for controlling a driving of the gate driving part 230.

The timing controller 300 generates an error condition signal FF based on the first image signal DATA1 and the first control signal CONT1. The error condition signal FF is a signal for detecting an abnormal driving of the timing controller 300 in advance, and is fed back to the image board 100.

The image board 100 restores the timing controller 300 based on the error condition signal FF provided from the timing controller 300.

The timing controller 300 includes a logic part 310 and an error-detecting part 330. The logic part 310 calculates coefficients, used to convert the first image signal DATA1 into the second image signal DATA2, based on a look-up table read out from an external storage part. The second image signal DATA2 is outputted to the data driving part 210.

The error-detecting part 330 generates the error condition signal FF based on the first image signal DATA1 and the first control signal CONT1. The error-detecting part 330 compares the coefficients and the first control signal CONT1 with reference data stored in the external storage part, and generate the error condition signal FF when the coefficients and the first control signal CONT1 are different from the reference data. A detailed description of a feedback of the error condition signal FF and a restoration of the timing controller 300 will be described later in detail.

The display panel 200 includes an array substrate, an opposite substrate and a liquid crystal layer disposed between the array substrate and the opposite substrate. The display panel 200 includes a plurality of data lines DL, a plurality of gate lines GL crossing the data lines DL, and a plurality of pixels P electrically connected to the data lines DL and the gate lines GL.

In one exemplary embodiment, for example, the first gate lines GL may extend along a first direction, and the data lines DL may extend along a second direction substantially perpendicular to the first direction. Each pixel P includes a switching element TR, a liquid crystal capacitor CLC and a storage capacitor CST.

The data driving part 210 converts the second image signal DATA2 into a data voltage of an analog type using the data control signal CONT2 and a gamma reference voltage Vgamma. The data driving part 210 outputs the data voltage to the data lines DL of the display panel 200.

A gamma voltage generating part (not shown) generates the gamma reference voltage to provide the data driving part 210 with the gamma reference voltage. In an exemplary embodiment, the gamma voltage generating part may be disposed within the data driving part 210. In an alternative exemplary embodiment, the gamma voltage generating part may be disposed within the timing controller 300.

In an exemplary embodiment, the data driving part 210 may be disposed, e.g., directly mounted, on the display panel 200 or may be connected to the display panel 200 in a tape carrier package ("TCP") structure. In an alternative exemplary embodiment, the data driving part 210 may be integrated into the display panel 200.

The gate driving part 230 generates a gate signal in response to the gate control signal CONT3. The gate driving part 230 generates the gate signal using an on voltage Von, an off voltage Voff and a common voltage Vcom to output the gate signal to the gate lines GL of the display panel 100.

In an exemplary embodiment, the gate driving part 230 may be disposed, e.g., directly mounted, on the display panel 200 or may be connected to the display panel 200 in a TCP structure. In an alternative exemplary embodiment, the gate driving part 230 may be integrated into the display panel 200.

In such an exemplary embodiment, it is described that the display panel 200 is employed in a liquid crystal display ("LCD") device. In an alternative exemplary embodiment, the display panel 200 may be employed in other types of display device, such as a plasma panel display ("PDP") device, an organic light-emitting diode ("OLED") device and a field emission display ("FED") device, for example.

As described above, the display panel 200 displays an image based on the second image signal DATA2, a data control signal CONT2 and the gate control signal CONT3 provided from the timing controller 300. Thus, when the timing controller 300 is abnormally driven, display quality of an image displayed on the display panel 200 is thereby reduced.

In an exemplary embodiment, the error condition signal FF for detecting an abnormal driving condition of the timing controller 300 is generated from the error-detecting part 330 and transmitted to be fed back to the image board 100. The image board 100 that receives the error condition signal FF may restore the timing controller 300 based on the error condition signal FF.

Accordingly, the abnormal driving condition of the timing controller 300 is detected and removed in advance, such that a malfunction of the display device, which is generated by the abnormal driving of the timing controller 300, is effectively prevented.

As shown in FIG. 2, the timing controller 300 and the image board 100 exchange signals with each other in an inter-integrated circuit ("$I^2C$") communication.

The $I^2C$ communication is a two-wire communication interface, and these two wires typically includes a serial data line ("SDA") provided for inputting/outputting data and a serial clock line ("SCL") provided for controlling a data communication between the timing controller 300 and the image board 100 and for generating a clock. The timing controller 300 and the image board 100 that are connected in the $I^2C$ communication are identified by a unique address, and each of the timing controller 300 and the image board 100 may transmit or receive data.

A data may be delivered between the timing controller 300 and the image board 100 by a master-slave protocol. A master starts a data transmission and generates clocks. Remaining circuits except the master correspond to a slave which sends and receives data.

When a power-on signal is applied from the image board 100, the timing controller 300 reads out a parameter or a look-up table from the external storage part (refer to FIG. 4). In an exemplary embodiment, the timing controller part and the external storage part may transmit signals using the $I^2C$ communication. In such an embodiment, the timing controller 300 may be a master mode device, and the external storage part may be a slave mode device.

The external storage part may be an electrically erasable programmable read only memory ("EEPROM"). The external storage part may store a plurality of look-up tables, the coefficients and various parameters used to check abnormality of the first control signal, e.g., check whether the first control signal CONT1 is abnormal or not.

When the timing controller 300 loads the parameter or the look-up table, the timing controller 300 is converted from a master mode to a slave mode. That is, when a driving of the timing controller 300 is prepared, the $I^2C$ communication between the timing controller 300 and the external storage part ends.

Then, in an exemplary embodiment, the $I^2C$ communication is performed between the timing controller 300 and the image board 100. In such an embodiment, the image board 100 may be in a master mode, and the timing controller 300 may be in a slave mode.

A signal is periodically transmitted between the serial data line SDA and the serial clock line SCL in the timing controller 300 and the image board 100. The image board 100 may periodically check the abnormal driving condition of the timing controller 300, e.g., whether an abnormal driving condition occurs in the timing controller 300 or not, through the serial data line SDA and the serial clock line SCL.

When absence of the abnormal driving condition in the timing controller 300 is checked, the timing controller 300 outputs the second image signal DATA2, the data control signal CONT2 and the gate control signal CONT3 for driving the display panel 200. When the abnormal driving condition occurs in the timing controller 300, the timing controller 300 does not output the signals for driving the display panel 200 to feed back the error condition signal FF to the image board 100.

The error condition signal FF may be generated based on the first image signal DATA1 and the first control signal CONT1 provided from the image board 100. In one exemplary embodiment, for example, the error-detecting part 330 compares coefficients calculated by the logic part 310 and the first control signal CONT1 with reference data read out from the external storage part, and then the error-detecting part 330 generates the error condition signal FF when the coefficients and the first control signal CONT1 are different from the reference data.

The error-detecting part 330 may include a plurality of detecting parts and a register 340. In one exemplary embodiment, for example, as shown in FIG. 2, the error-detecting part 330 may include a first detecting part 331, a second detecting part 332 and a third detecting part 333. In such an embodiment, the error-detecting part 330 includes three detecting parts. In an alternative exemplary embodiment, the error-detecting part 330 may include two detecting parts or no less than four detecting parts.

The first to third detecting parts 331, 332 and 333 may detect different types of abnormal driving condition, and thereby output the first error condition signal FF1, a second error condition signal FF2 and a third error condition signal FF3, respectively.

In an exemplary embodiment, the first to third error condition signals FF1, FF2 and FF3 may be one of a clock error signal, a data enable error signal and a coefficient error signal. Hereinafter, for convenience of description, it will be described that the first to third error condition signals FF1, FF2 and FF3 will be defined as a clock error signal, a data enable error signal and a coefficient error signal, respectively.

The first detecting part 331 checks abnormality of a clock signal CLK, e.g., whether a clock signal CLK is an abnormal or not, and thereby outputs the clock error signal. In one exemplary embodiment, for example, when the clock signal is not applied, the first detecting part 331 may output the clock error signal. The clock signal CLK may be one of a main clock signal, a data clock signal and a gate clock signal. The first detecting part 331 compares the clock signal CLK with a reference parameter stored in the external storage part. When it is checked that the clock signal CLK is not identical to the reference parameter, the first detecting part 331 may output the clock error signal.

The second detecting part 332 checks abnormality of the data enable signal DE, e.g., whether the data enable signal DE is abnormal or not, and thereby outputs the data enable error signal. Referring to FIG. 3, when a high interval HP of the data enable signal DE is not maintained during a predetermined time, the second detecting part 332 may output the data enable error signal. In one exemplary embodiment, for example, when the display panel 200 has a resolution of 1,366×768 pixels, a maintain time of the high interval of the data enable signal DE may be a time corresponding to 1,366 pixels.

In such an embodiment, the external storage part may store a minimum value and a maximum value corresponding to a time during which the high interval HP of the data enable signal DE is to be maintained. When the maintain time of the high interval HP of the data enable signal DE is not within a range between the minimum value and the maximum value, the second detecting part 332 may output the data enable error signal.

In an exemplary embodiment, when a summation interval of a high interval HP and a low interval LP of the data enable signal DE is not maintained during a predetermined interval, the data enable error signal may be outputted.

In such an embodiment, the external storage part may store a minimum value and a maximum value of the summation interval. When the summation interval is not within a range between the minimum value and the maximum value, the second detecting part 332 may output the data enable error signal.

In an exemplary embodiment, when the data enable signal DE in a frame interval FP is not maintained during a predetermined interval, the data enable error signal may be outputted.

In such an embodiment, the external storage part may store a minimum value and a maximum value of an interval, during which the data enable signal DE is to be maintained in the frame interval FP. When a maintain time is not between the minimum value and the maximum value within the frame interval FP of the data enable signal DE, the second detecting part 332 may output the data enable error signal. In one exemplary embodiment, for example, when the display panel 200 has a resolution of 1,366×768 pixels, the data enable signal DE may have 768 pulses for the frame interval FP.

In an exemplary embodiment, when a summation interval of the frame interval FP and a blank interval BP of the data enable signal DE is not maintained during a predetermined interval, the data enable error signal may be outputted.

In such an embodiment, the external storage part may store a minimum value and a maximum value of an interval that the frame interval FP and the blank interval BP of a data enable signal DE are added together. The second detecting part 332 may output the data enable error signal, when an interval that the frame interval FP and the blank interval BP of the data enable signal DE are added together is not in a range between the minimum value and the maximum value.

The third detecting part 333 checks abnormality of coefficients calculated by the logic part 301, e.g., whether coefficients calculated by the logic part 310 are abnormal or not, and thereby outputs the coefficient error signal. Referring to FIG. 4, the logic part 310 may include a first storage part 311, a calculating part 313 and a second storage part 315. The logic part 310 may further include an interpolating part 317.

The first storage part 311 stores a look-up table ("LUT") loaded from an external storage part 20 and the first image signal DATA1 provided from the image board 100. The calculating part 313 calculates coefficients COEF based on the LUT stored in the first storage part 311 and the first image signal DATA1.

The second storage part 315 stores the coefficients COEF calculated by the calculating part 313. The coefficients COEF calculated by the calculating part 313 may be all coefficients or partial coefficients required for driving the display panel 200. When the coefficients COEF calculated by the calculating part 313 are partial coefficients, the interpolating part 317 may calculate remaining coefficients COEF.

The coefficient COEF stored in the second storage part 315 may be provided to the third detecting part 333. The third detecting part 333 may include a checksum comparison part 334. The checksum comparison part 334 may compare a total sum value N of a sequential total sum of the calculated coefficients COEF and a checksum value CS stored in the external storage part 20 with a predetermined value F.

In one exemplary embodiment, for example, as shown in FIG. 5, the total sum value N has 256 addresses ADD, e.g., from 0 to 255, and the predetermined value F is calculated as a value of 252 in advance to be stored in the external storage part 20. The addresses ADD and the coefficients COEF are in one-to-one (1:1) correspondence. As shown in a table of FIG. 6, the coefficients COEF calculated at the calculating part 313 are arranged in accordance with the addresses ADD.

When the total sum value of the sequential total sum N of the calculated coefficients COEF and the checksum value CS stored in the external storage part 20 is equal to the predetermined value F, the coefficients COEF are normally calculated by the calculating part 313.

When the total sum value of the sequential total sum N of the calculated coefficients COEF and the checksum value CS stored in the external storage part 20 is different from the predetermined value F, the coefficients COEF are abnormally calculated by the calculating part 313, and the third detecting part 333 may output the coefficient error signal.

The register 340 stores the first to third error condition signals FF1, FF2 and FF3 outputted from the first to third detecting parts 331, 332 and 333. Then, the first to third error condition signals FF1, FF2 and FF3 are transmitted to the image board 100, when the image board 100 requests the first to third error condition signals FF1, FF2 and FF3. Since an $I^2C$ communication is performed between the timing controller 300 and the image board 100 with a predetermined period, information of the register 340 is periodically scanned.

Each of the first to third error condition signals FF1, FF2 and FF3 may include at least one of information on existence or nonexistence of an error condition, an error condition type, a command for the image board 100 corresponding to types of the error condition, and a register values for operating the image board 100.

The existence or nonexistence of an error condition is information which notifies existence of an abnormal driving condition of the timing controller 300. In one exemplary embodiment, for example, the existence or nonexistence of an error condition corresponds to zero (0) when a driving condition of the timing controller 300 is normal, and the existence or nonexistence of an error condition corresponds to 1 when a driving condition of the timing controller 300 is abnormal. The error condition type is information corresponding to a type of abnormal driving condition of the timing controller 300. In one exemplary embodiment, for example, when data of the error condition type has 3 bits, 8 abnormal driving conditions may be identified.

The command for the image board 100 is information which notifies the image board 100 a function that the image board 100 should be performed in accordance with the error condition kinds. In one exemplary embodiment, for example, when the command for the image board 100 is 3 bits data, the number of functions of the image board 100 may be designated into eight. In one exemplary embodiment, for example, the command for the image board 100 may be a reset signal applied to the timing controller 300.

The register values for operating the image board 100 may be inner monitoring information of the timing controller 300 used to perform a function of the image board 100. In one exemplary embodiment, for example, the register values may be a count value of a counter which will be described in detail later.

The image board 100 may restore the timing controller 300 based on the first to third error condition signals FF1, FF2 and FF3. The image board 100 may perform a restoration of the timing controller 300 based one a command included in the first to third error condition signals FF1, FF2 and FF3.

The image board 100 applies a reset signal to the timing controller 300 or changes a value of coefficients COF calculated by the logic part 310 to restore the timing controller 300.

In an exemplary embodiment, the image board 100 applies a new clock signal CLK to the timing controller 300 when the clock error signal is applied thereto, and applies a new data enable signal DE to the timing controller 300 when the data enable error signal is applied thereto, such that the timing controller 300 may be restored.

In an exemplary embodiment, the timing controller 300 feeds back the first to third error condition signals FF1, FF2 and FF3 to the image board 100 through an $I^2C$ communication, such that a type of the error condition may be checked by the image board 100 and thus suitable actions may be possible, e.g., the error condition may be effectively prevented based on the type of the error condition.

Figure 7:
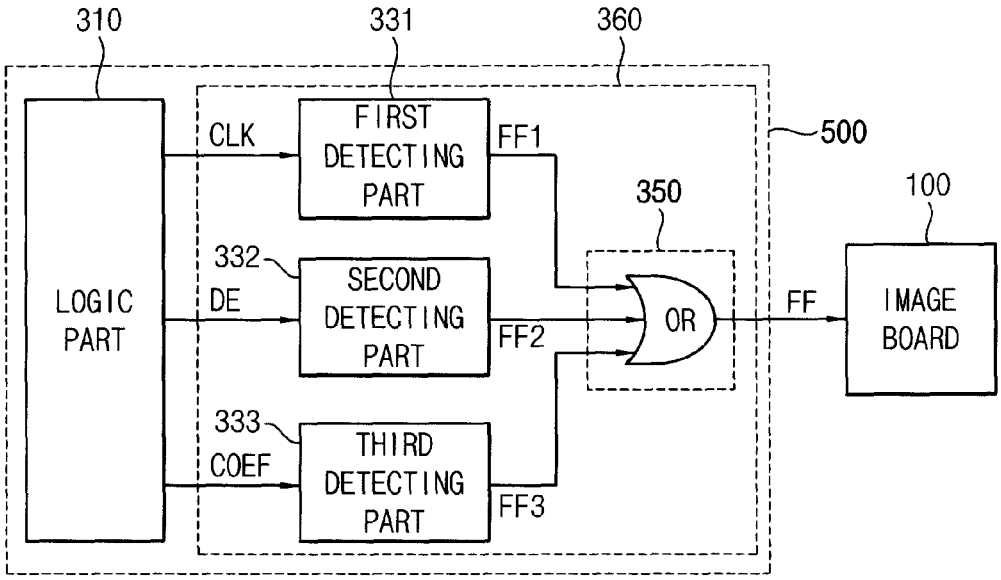
FIG. 7 is a block diagram illustrating an alternative exemplary embodiment of the driving apparatus according to the present invention.

FIG. 7 is a block diagram illustrating an alternative exemplary embodiment of the driving apparatus according to the present invention.

Referring to FIG. 7, the driving apparatus includes an image board 100 and a timing controller 500. The timing controller 500 includes a logic part 310 and an error-detecting part 360 which includes a plurality of detecting parts, e.g., the first detecting part 331, the second detecting part 332 and the third detecting part 333, and an arithmetic part 350.

The logic part 310 and the detecting parts 331, 332 and 333 of FIG. 7 are substantially the same as the logic part 310 and the detecting parts 331, 332 and 333 of FIG. 2, and thus any repetitive detailed explanation thereof will hereinafter be omitted.

The first to third detecting parts 331, 332 and 333 detect different types of abnormal driving condition, and thereby output a first error condition signal FF1, a second error condition signal FF2 and a third error condition signal FF3, respectively. The first to third error condition signals FF1, FF2 and FF3 may be one of a clock error signal, a data enable error signal and a coefficient error signal.

The arithmetic part 350 calculates a logical disjunction of the first to third error condition signals FF1, FF2 and FF3. In an exemplary embodiment, the arithmetic part 350 may include an OR gate. When one of the first to third error condition signals FF1, FF2 and FF3 is high, the arithmetic part 350 outputs an error condition signal FF.

The timing controller 500 feeds back the error condition signal FF to the image board 100. The timing controller 500 designates one of output terminals to an output terminal of the error condition signal FF, and outputs the error condition signal FF through the output terminal of the error condition signal FF.

When the error condition signal FF is inputted to the image board 100, the image board 100 may apply a reset signal to the timing controller 500 to restore the timing controller 500.

In an exemplary embodiment, the error condition signal FF is outputted using an output terminal of the timing controller 500, such that a restoring of the timing controller 500 may be effectively realized without a design change of the timing controller 500.

Figure 8:
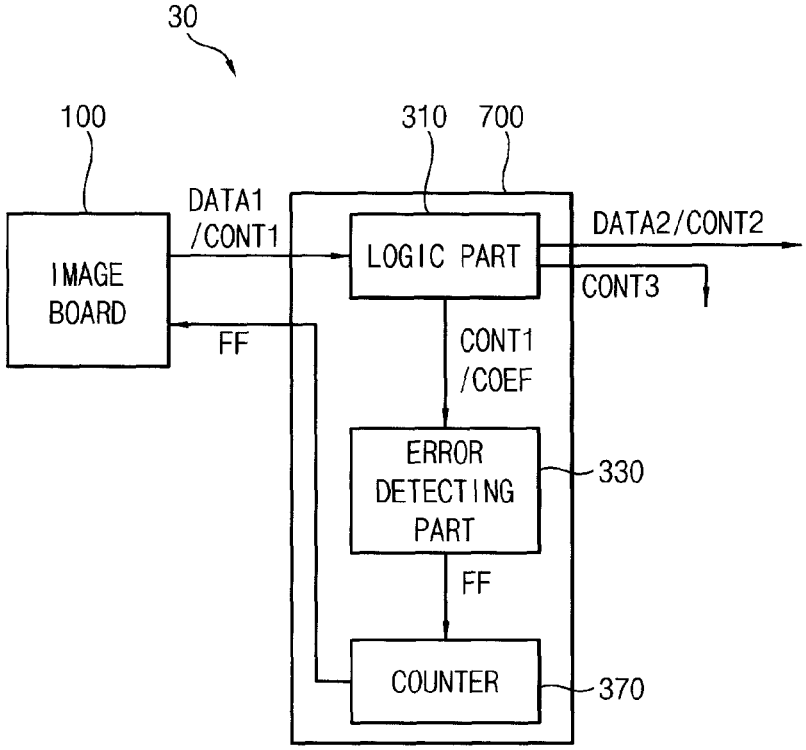
FIG. 8 is a block diagram illustrating another alternative exemplary embodiment of the driving apparatus according to the present invention.

FIG. 8 is a block diagram illustrating another alternative exemplary embodiment of the driving apparatus according to the present invention.

Referring to FIG. 8, the driving apparatus 30 is substantially the same as the driving apparatus 10 of FIG. 1 except for a counter 370. The same or like elements shown in FIG. 8 have been labeled with the same reference characters as used above to describe the exemplary embodiments of the driving apparatus shown in FIG. 1, and thus, any repetitive detailed description thereof will hereinafter be omitted or simplified.

The driving apparatus in FIG. 8 includes an image board 100 and a timing controller 700. The timing controller 700 includes a logic part 310, an error-detecting part 330 and a counter 370.

The counter 370 counts pulses of the error condition signal FF outputted from the error-detecting part 330, and records the counted number of the pulses.

Since the error condition signal FF is generated with respect to a real input of the timing controller 700, the error condition signal FF may also have real time characteristics. When the abnormal driving condition is not continued and restored, the error condition signal FF is restored. That is, a temporary abnormal driving condition is not found, such that a restoration of the timing controller 700 may not be performed when the error condition signal FF is not maintained in a predetermined time.

The timing controller 700 feeds back the error condition signal FF to the image board 100 when the number of error condition signal FF corresponds to, e.g., identical to, a predetermined value. In one exemplary embodiment, for example, the predetermined value may be three. In such an embodiment, when a same type of abnormal driving condition is repeated no less than three times, the timing controller 700 feeds back the error condition signal FF to the image board 100.

The error condition signal FF may be fed back to the image board 100 through an $I^2C$ communication. In an exemplary embodiment, one of output terminals of the timing controller 500 is designated as an output terminal of the error condition signal FF, and then the error condition signal FF may be fed back to the image board 100 through an output terminal of the error condition signal FF.

The image board 100 restores the timing controller 700 when the error condition signal FF is fed back thereto. The image board 100 applies a reset signal to the timing controller 700, or alters coefficient values COEF calculated by the logic part 310, such that the timing controller 700 may be restored.

In an exemplary embodiment, the image board 100 applies a new clock signal CLK to the timing controller 700 when the clock error signal is applied thereto, and applies a new data enable signal DE to the timing controller 700 when the data enable error signal is applied thereto, such that the timing controller 700 may be restored.

In an exemplary embodiment, the driving apparatus 30 may further include the counter 370, such that the timing controller 700 may be restored when the error condition signal FF is maintained. Thus, a restoring efficiency of the timing controller 700 is substantially enhanced.

Figure 9:
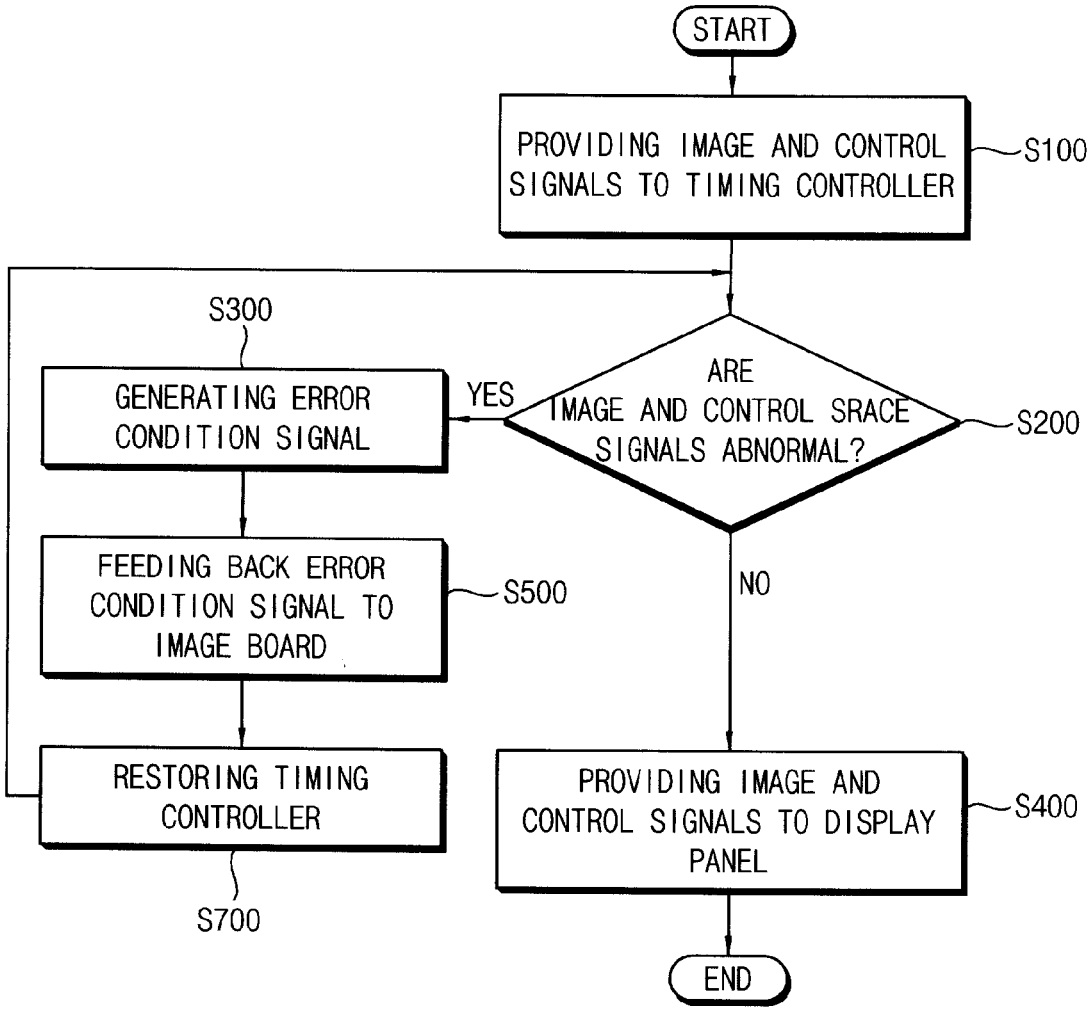
FIG. 9 is a flowchart showing an exemplary embodiment of a restoring method of a timing controller shown in FIG. 1.
Figure 10:
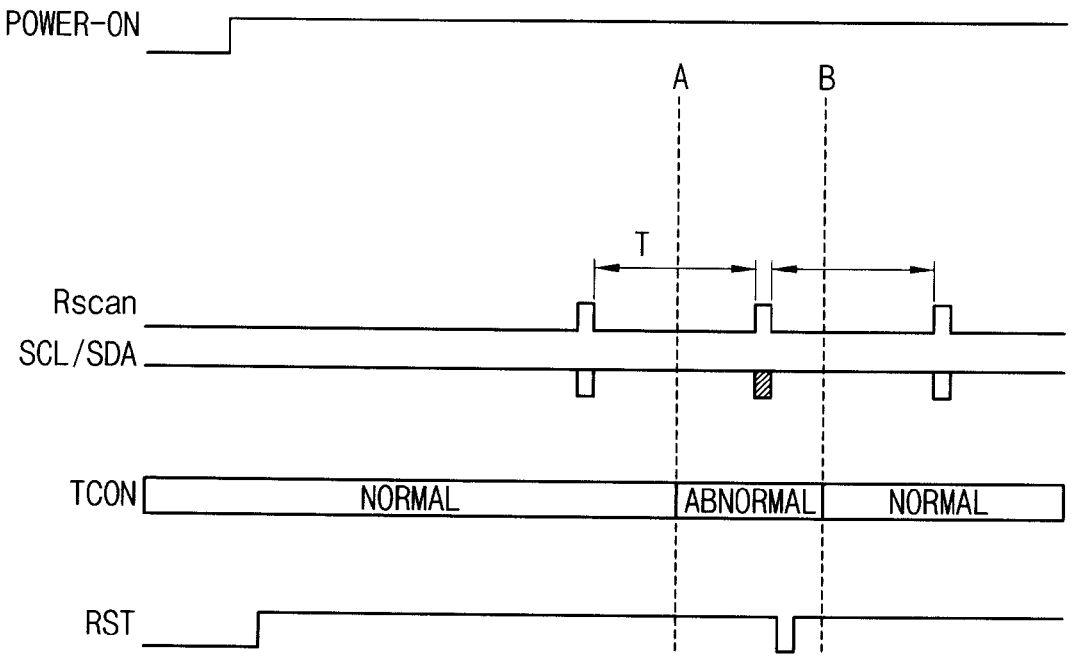
FIG. 10 is a signal timing diagram showing a restoring process of the timing controller shown in FIG. 9.

FIG. 9 is a flowchart showing an exemplary embodiment of a method of restoring a timing controller shown in FIG. 1. FIG. 10 is a signal timing diagram showing a restoring process of the timing controller shown in FIG. 9.

Referring to FIGS. 9 and 10, the image board 100 provides the timing controller 300 with a first image signal DATA1 and a first control signal CONT1 (step S100).

When a power-on signal POWER-ON is output from the image board 100, the timing controller 300 reads out parameters and a look-up table from the external storage part (refer to FIG. 4).

When the parameters and the look-up table are loaded to the timing controller 300, an $I^2C$ communication is performed between the timing controller 300 and the image board 100. In such an embodiment, signals may be transmitted between the timing controller 300 and the image board 100 through the serial data line SDA and the serial clock line SCL with a predetermined period T.

The timing controller 300 checks abnormality of the first image signal DATA1 and the first control signal CONT1, e.g., whether or not the first image signal DATA1 and the first control signal CONT1 are abnormal (step S200). The timing controller 300 provides the display panel 200 with an output signal when the first image signal DATA1 and the first control signal CONT1 are normal, e.g., when there is no abnormality in the first image signal DATA1 and the first control signal CONT1 (step S400).

The output signal of the timing controller 300 may be a plurality of timing signals generated based on the first control signal CONT1 and a second image signal DATA2 converted from the first image signal DATA1. The timing signals may include a data control signal CONT2 and a gate control signal CONT3.

The display panel 200 displays an image based on the second image signal DATA2, the data control signal CONT2 and the gate control signal CONT3 that are provided from the timing controller 300.

When the first image signal DATA1 and the first control signal CONT1 are abnormal, the timing controller 300 generates an error condition signal FF without providing the display panel 200 with an output signal (step S300).

The timing controller 300 includes a logic part 310 and an error-detecting part 330. The logic part 310 calculates coefficients for converting the first image signal DATA1 into the second image signal DATA2 based on a look-up table read out from the external storage part. The second image signal DATA2 is outputted to the data driving part 210. The external storage part may be an EEPROM.

The error-detecting part 330 generates the error condition signal FF based on the first image signal DATA1 and the second control signal CONT1. The error-detecting part 330 may compare the coefficients and the first control signal CONT1 with reference data stored in the external storage part. When the coefficients and the first control signal CONT1 are different from the reference data, the error-detecting part 330 generates the error condition signal FF.

In an exemplary embodiment, the timing controller 700 may further include a counter 370. In such an embodiment, the counter 370 counts pulses of the error condition signal FF outputted from the error-detecting part 330, and feeds back the error condition signal FF to the image board 100 when a counted number of the pulses corresponds to a predetermined number.

The error-detecting part 330 may include a plurality of detecting parts and a register 340. At least one of the error-detecting parts 330 may check abnormality of a clock signal CLK, e.g., whether or not the clock signal CLK is abnormal, to output the clock error signal. In an exemplary embodiment, at least one of the error-detecting parts 30 may check abnormality of a data enable signal, e.g., whether or not the data enable signal DE is abnormal, to output the data enable error signal. In such an embodiment, a reference parameter for the clock signal CLK and the data enable signal DE may be stored in the external storage part.

In an exemplary embodiment, at least one of the error-detecting parts 330 may check abnormality of coefficients COEF calculated by the lock part 310, e.g., whether or not the coefficients COEF calculated by the logic part 310 are abnormal, to output the coefficient error signal. In such an embodiment, the error-detecting part 330 may check whether or not the coefficients COEF are normally calculated using a check-sum value CS stored in the external storage part.

The timing controller 300 feeds back an error condition signal FF to the image board 100 (step S500).

An error condition signal FF outputted from the plural detecting parts is stored in the register 340. Since an $I^2C$ communication is performed between the timing controller 300 and the image board 100 with a predetermined period, information of the register 340 is periodically scanned. In an exemplary embodiment, the information of the register 340 may be periodically scanned by rescan signal Rscan. When an error condition is generated at 'A' point in the driving condition of the timing controller TCON of FIG. 10, the timing controller 700 notifies an abnormal condition to the image board 100 through a data line SDA.

The error condition signal FF may include at least one of information on existence or nonexistence of an error condition, an error condition type, a command for the image board 100 corresponding to the error condition kinds, and a register value for operating the image board.

The image board 100 restores the timing controller 300 based on the error condition signal FF (step S700).

The image board 100 restores the timing controller 300 based on the first to third error condition signals FF1, FF2 and FF3. The image board 100 may perform a restoring process of the timing controller 300 based on a command of the image board 100, which is included in the first to third error condition signals FF1, FF2 and FF3.

In an exemplary embodiment, the image board 100 may apply a reset signal RST to the timing controller 300, as shown in FIG. 10, to restore the timing controller 300. In such an embodiment, the timing controller 700 may be restored in a normal state at a point 'B' in the driving condition of the timing controller TCON as shown in FIG. 10.

In an exemplary embodiment, the image board 100 may alter the coefficients COEF calculated by the logic part 310 to restore the timing controller 300. In an alternative exemplary embodiment, the image board 100 may apply a new clock signal CLK to the timing controller 300 when the clock error signal is applied thereto, and apply a new data enable signal DE to the timing controller 300 when the data enable error signal is applied thereto to restore the timing controller 300.

In an exemplary embodiment, the error condition signal FF is fed back to the image board 100 through $I^2C$ communication between the timing controller 300 and the image board 100. In an alternative exemplary embodiment, as shown in FIG. 7, the timing controller 500 may designate one of output terminals of the timing controller 500 into an output terminal of the error condition signal FF, and may output the error condition signal FF through the output terminal of the error condition signal FF.

In an exemplary embodiment, the timing controller 300 feeds back the first to third error condition signals FF1, FF2 and FF3 to the image board 100 through an $I^2C$ communication, such that the type of error conditions is effectively checked by the image board 100 and thus suitable actions may be possible, e.g., the error condition may be effectively prevented based on the checked type of the error condition.

As described above, in such an embodiment, the timing controller detects an error condition to feed back an error condition signal to an image board, and the image board restores the timing controller based on the error condition signal. Thus, display defects due to an abnormal operation of the timing controller are effectively prevented, and display quality of a display device is thereby substantially enhanced.

In an exemplary embodiment, the timing controller feeds back the first to third error condition signals to the image board through an $I^2C$ communication, such that types of error condition are checked by the image board and thus suitable actions may be possible, e.g., the error condition may be effectively prevented based on the type of the error condition.

In an alternative exemplary embodiment, an output terminal of the timing controller is designated as an output terminal of the error condition signal to output the error condition signal. In such an embodiment, a restoring of the timing controller may be easily realized without a design change of the timing controller.

The foregoing is illustrative of the present invention and is not to be construed as limiting thereof. Although a few exemplary embodiments of the present invention have been described, those skilled in the art will readily appreciate that many modifications are possible in the exemplary embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific exemplary embodiments disclosed, and that modifications to the disclosed exemplary embodiments, as well as other exemplary embodiments, are intended to be included within the scope of the appended claims. The present invention is defined by the following claims, with equivalents of the claims to be included therein.

What is claimed is:

1. A method of restoring a timing controller, the method comprising:

generating an error condition signal from a timing controller by checking abnormality of an image signal and a control signal provided from an image board;

feeding back the error condition signal to the image board; and restoring the timing controller based on the error condition signal.

2. The method of claim 1, wherein the generating the error condition signal comprises:

calculating coefficients from the image signal based on a look-up table loaded from an external storage part;

comparing the coefficients and the control signal with reference data stored in the external storage part; and generating the error condition signal when the coefficients and the control signal are different from the reference data.

3. The method of claim 2, wherein the generating the error condition signal further comprises:

counting pulses of the error condition signal; and outputting the error condition signal when a counted number of the pulses of the error condition signal corresponds to a predetermined value.

4. The method of claim 2, wherein the comparing the coefficients and the control signal with the reference data comprises comparing a sequential summation of the calculated coefficients and a summation of checksum stored on the external storage part with the reference data.

5. The method of claim 2, wherein the comparing the control signal with the reference data comprises comparing a clock signal and a data enable signal with the reference data stored in the external storage part.

6. The method of claim 2, wherein the generating the error condition signal comprises:

detecting a plurality of error conditions different from each other and outputting a plurality of error condition signals based on the plurality of error conditions; and storing the plurality of error condition signals.

7. The method of claim 6, wherein the stored error condition signals are transmitted to the image board through an inter-integrated circuit communication, when the image board requests the plurality of error condition signals.

8. The method of claim 7, wherein the restoring the timing controller comprises altering the calculated coefficients.

9. The method of claim 2, wherein the generating the error condition signal comprises:

detecting a plurality of error conditions different from each other and outputting a plurality of error condition signals; and performing a logical disjunction on the plurality of error condition signals to output the error condition signal.

10. The method of claim 1, wherein the restoring the timing controller comprises initiating the timing controller.

11. A driving apparatus comprising:

a timing controller which generates an error condition signal by checking abnormality of an image signal and a control signal; and an image board which provides the image signal and the control signal to the timing controller and restores the timing controller based on the error condition signal provided from the timing controller.

12. The driving apparatus of claim 11, wherein the timing controller comprises:

a logic part which calculates coefficients from the image signal based on a look-up table loaded from an external storage part; and an error-detecting part which compares the coefficients and the control signal to generate the error condition signal when the coefficients and the control signal are different from reference data.

13. The driving apparatus of claim 12, wherein the timing controller further comprises a counter which counts pulses of the error condition signal to output the error condition signal when a counted number of the pulses of the error condition signal corresponds a predetermined number.

14. The driving apparatus of claim 12, wherein the error-detecting part comprises:

a plurality of detecting parts which detects a plurality of error conditions different from each other to output a plurality of error condition signals, respectively; and a register which stores the plurality of error condition signals.

15. The driving apparatus of claim 14, wherein the error-detecting part transmits the stored error condition signals to the image board through an inter-integrated circuit communication, when the image board requests the error condition signals.

16. The driving apparatus of claim 15, wherein the image board alters the coefficients to restore the timing controller.

17. The driving apparatus of claim 15, wherein the error condition signal comprises at least one of information on existence or nonexistence of an error condition, an error condition type, a command for the image board corresponding to the error condition type, and a register value for operating the image board.

18. The driving apparatus of claim 12, wherein the error-detecting part comprises:

a plurality of detecting parts which detects different error conditions to output a plurality of error condition signals; and an arithmetic part which performs a logical disjunction on the plurality of error condition signals to output the error condition signal.

19. The driving apparatus of claim 11, wherein the error condition signal is outputted to the image board through an output terminal of the timing controller.

20. The driving apparatus of claim 11, wherein the image board initiates the timing controller to restore the timing controller when the error condition signal is inputted thereto.

* * * * *

UNITED STATES PATENT AND TRADEMARK OFFICE

CERTIFICATE OF CORRECTION

PATENT NO. : 8,547,367 B2
APPLICATION NO. : 13/178939
DATED : October 1, 2013
INVENTOR(S) : Yong-Bum Kim et al.

It is certified that error appears in the above-identified patent and that said Letters Patent is hereby corrected as shown below:

Title Page Item (30), Foreign Application Priority Data, insert -- Dec. 6, 2010 (KR) ..... 10-20100123643 --; and In the Specification Column 1, line 6, after the word No. delete "2010-0123643" and insert -- 10-2010-0123643 --.

Signed and Sealed this
Seventh Day of July, 2015

Michelle K. Lee

Michelle K. Lee
*Director of the United States Patent and Trademark Office*